United States Patent [19]

Narita et al.

[11] Patent Number: 4,741,319

[45] Date of Patent: May 3, 1988

[54] IGNITION SYSTEM FOR INTERNAL COMBUSTION ENGINES

[75] Inventors: Ko Narita, Aichi; Koichi Toyama, Kariya; Toshihito Nonaka, Obu, all of Japan

[73] Assignee: Nippondenso Co. LTD., Kariya, Japan

[21] Appl. No.: 82,658

[22] Filed: Aug. 7, 1987

[30] Foreign Application Priority Data

Aug. 22, 1986 [JP] Japan ..... 61-197966

[51] Int. Cl.[4] ..... F02P 3/045

[52] U.S. Cl. ..... 123/609; 123/652

[58] Field of Search ..... 123/415, 416, 417, 427, 123/609, 610, 651, 652

[56] References Cited

U.S. PATENT DOCUMENTS

| | | | |
|---|---|---|---|
| 3,937,193 | 2/1976 | Kim | 123/611 |
| 4,043,302 | 8/1977 | Sessions | 123/609 |
| 4,228,779 | 10/1980 | Wetzel | 123/652 |
| 4,267,813 | 5/1981 | Hohne et al. | 123/609 |
| 4,276,860 | 7/1981 | Capurka | 123/609 X |
| 4,380,989 | 4/1983 | Takaki | 123/609 X |

FOREIGN PATENT DOCUMENTS 23394 2/1980 Japan .

*Primary Examiner*—Tony M. Argenbright

*Attorney, Agent, or Firm*—Cushman, Darby & Cushman

[57] ABSTRACT

An ignition system for internal combustion engines is constructed so that, in response to each ignition signal from ignition signal generating means, through a predetermined angle before a succeeding ignition timing, a storage quantity of storing means is gradually increased from an initial value and then it is gradually decreased, and a time point when the storage quantity of the storing means has been decreased to reach the initial value is detected by first storage quantity detecting means to thereby turn on a power transistor for turning on and off a primary current of an ignition coil at that time point, and further the fact that the storage quantity of the storing means has been decreased to reach a set value larger than the initial value is detected by second storage quantity detecting means to thereby change a decrease rate of the storage quantity of the storing means.

11 Claims, 7 Drawing Sheets

IGNITION SYSTEM FOR INTERNAL COMBUSTION ENGINES

BACKGROUND OF THE INVENTION

1. FIELD OF THE INVENTION

The present invention relates to an ignition system for internal combustion engines in which the energization time of an ignition coil is controlled.

2. DESCRIPTION OF THE RELATED ART

As examples of a conventional ignition system for internal combustion engines of the type described above, there are a system in which a storage quantity of storing means is gradually increased through a predetermined angle from the reception of an ignition signal to an ignition timing, and then the thus increased storage quantity is decreased, and the decrease rate of the storage quantity is changed after the lapse of a predetermined time so that the energization of an ignition coil is initiated at a time point when the storage quantity has been decreased to its initial value (for example, as disclosed in Japanese Patent Unexamined Publication No. 55-23394 (1980)); a system in which a storage quantity of storing means is gradually increased through a predetermined angle from an ignition timing, and then, after a lapse of a predetermined time, the thus increased storage quantity is gradually decreased without changing the storage quantity decrease rate so that the energization of an ignition coil is initiated at a time point when the storage quantity has been decreased to a set value which is larger than its initial value (for example, as disclosed in U.S. Pat. No. 3,937,193), etc.

In the former one of the foregoing conventional ignition systems, however, the decrease rate of the storage quantity is changed after a predetermined time has elapsed from the ignition timing, so that it is necessary to use a monostable circuit or a counter for detecting a time point when the predetermined time has elapsed from the ignition timing. Accordingly, this system has a disadvantage that the circuit of this system becomes extremely large in scale.

In the latter one of the foregoing conventional ignition systems, on the other hand, the storage quantity is gradually decreased from a predetermined angular position immediately before a succeeding ignition timing so that the energization of an ignition coil is initiated at a time point when the storage quantity has reached a predetermined value. Accordingly, when the ignition timing is advanced upon quick acceleration of an internal combustion engine, etc., an ignition signal for turning off a power transistor may be applied before a sufficient primary current flow is established in an ignition coil, so that this system has a disadvantage that a high voltage for ignition cannot be generated in the ignition coil.

SUMMARY OF THE INVENTION

It is therefore an object of the present invention to eliminate the foregoing disadvantages of the prior art.

It is another object of the present invention to provide an ignition system for an internal combustion engine which can generate sufficient ignition energy by using a system structure including a circuit of a relatively small scale, even upon quick acceleration of the internal combustion engine.

In order to attain the above-mentioned objects, the present invention provides an ignition system for an internal combustion engine which comprises: an ignition coil for generating a high voltage for ignition upon turning-off of a primary current flowing therethrough; a power transistor for turning on and off the primary current flowing through the ignition coil; ignition signal generating means for generating an ignition signal of a predetermined angular width for turning off the power transistor at an ignition timing in accordance with a rotational speed of the internal combustion engine; storing means for gradually increasing a storage quantity thereof from an initial value in responsive to the ignition signal through a predetermined angle before a succeeding ignition timing and then gradually decreasing the storage quantity thereof; first storage quantity detecting means for detecting a time point, where the storage quantity of the storing means has decreased and reached the initial value, and turning on the power transistor; and second storage quantity detecting means for detecting the fact that the storage quantity of the storing means has decreased and reached a set value larger than the initial value and changing a decrease rate of the storage quantity of the storing means.

With the above-mentioned structure, the ignition system for interval combustion engines according to the present invention operates in such a manner that, in response to the ignition signal from the ignition signal generating means, the storage quantity of the storing means is gradually increased from the initial value through a predetermined angle until a succeeding ignition timing is reached and then it is gradually decreased, and in that a time point when the storage quantity of the storing means has been decreased and has reached the initial value is detected by the first storage quantity detecting means to thereby turn on the power transistor, and at the same time, the fact that the storage quantity of the storing means has been decreased and has reached the set value larger than the initial value is detected by the second storage quantity detecting means to thereby change the decrease rate of the storage quantity.

BRIEF DESCRIPTION OF THE DRAWINGS

Other objects and advantages of the present invention will become apparent from the following explanation made in conjunction with the accompanying drawings, wherein.

DESCRIPTION OF THE PREFERRED EMBODIMENTS

Embodiments of the ignition system for an internal combustion engine according to the present invention will be described hereunder with reference to the accompanying drawings.

Figure 1:
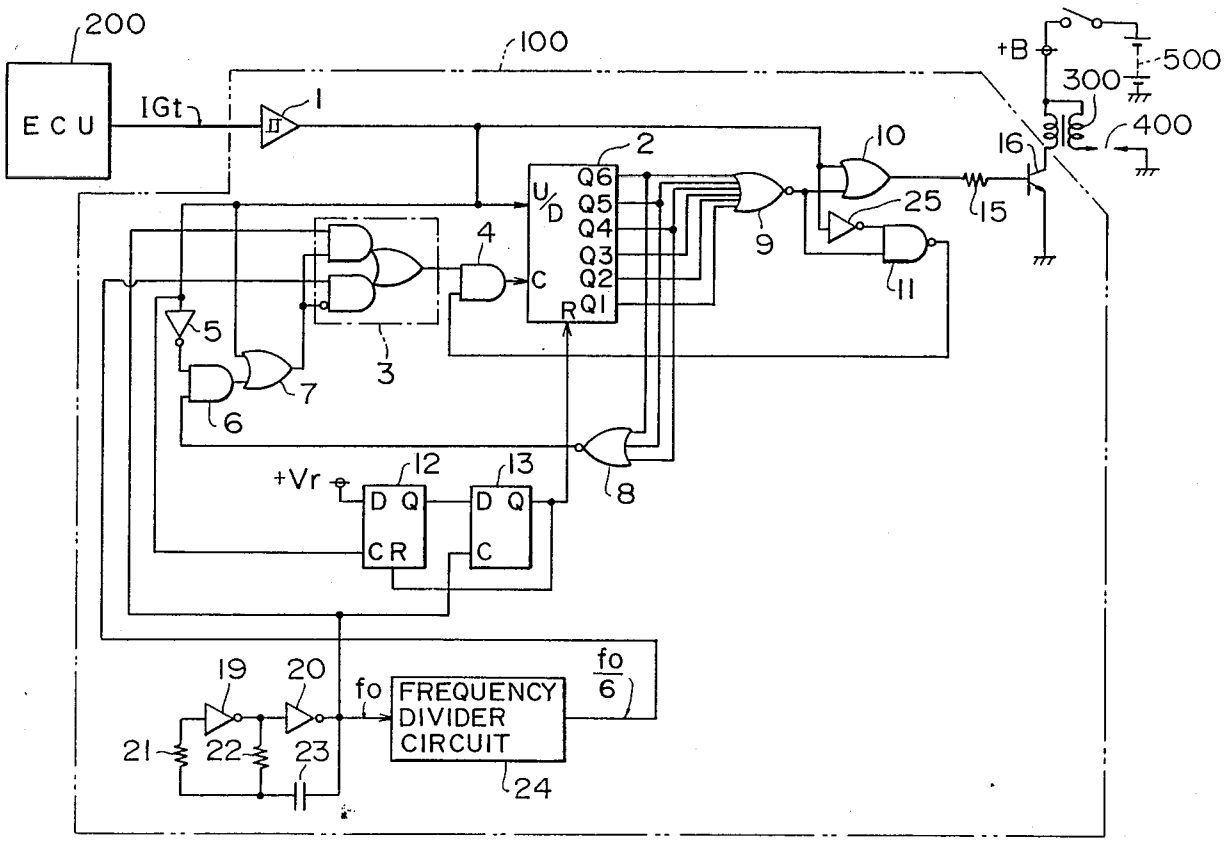
FIG. 1 is an electric circuit diagram showing an ignition system for internal combustion engines of a first embodiment of the present invention.

In a first embodiment shown in FIG. 1, reference numeral 100 designates an ignitor which controls turning on and off of an energization current flowing through an ignition coil 300 in response to an ignition signal IGt supplied from an engine control unit (hereinafter abbreviated to "ECU") 200. The ECU 200 is ignition signal generating means for electronically operating an ignition timing in accordance with engine parameters and supplying the ignition signal IGt to the ignition 100. This ignition signal IGt is a pulsed signal which a predetermined crank angle width and represents an ignition timing. In some cases, this crank angle width may be variable in accordance with various conditions of the engine. Reference numeral 300 designates an ignition coil which generates a high voltage for ignition at the secondary side thereof in response to an output signal of the ignitor 100. Reference numeral 400 designates ignition plugs which are arranged on respective cylinders of the engine and are connected to the secondary side of the ignition coil 300 via a distributor (not shown). Reference numeral 500 designates a power source battery.

Next, the structure of the ignitor 100 will be described in detail. Reference numeral 1 designates a Schmitt trigger circuit for shaping the waveform of the ignition signal IGt from the ECU 200. Reference numeral 2 designates an up/down counter 2 (hereinafter abbreviated to "U/D counter") which acts as storing means and repeats an up/down operation in response to the shaped waveform of the ignition signal IGt. Reference numeral 3 designates an AND-OR selector gate for switching the clock frequency of a clock signal supplied to the U/D counter 2.

Reference numeral 4 designates an AND gate for inhibiting a clock signal input to the U/D counter 2 so as to prevent the U/D counter 2 from overflowing. Reference numerals 5, 6 and 7 respectively designate a NOT gate, an AND gate, and an OR gate which cooperate to form a clock frequency switching signal to be supplied to the AND-OR selector gate 3.

Reference numeral 8 designates a NOR gate acting as second storage quantity detecting means for detecting a signal for switching the clock frequency of the U/D counter 2 in accordance with an output state of the U/D counter 2. Reference numeral 9 designates a NOR gate acting as first storage quantity detecting means for encoding an output of the U/D counter 2 to thereby obtain an energization initiation signal.

Reference numeral 10 designates an OR gate which produces an energization signal for energizing a primary coil of the ignition coil 300 on the basis of the ignition signal IGt and an output signal of the NOR gate 9. Reference numerals 25 and 11 respectively designate a NOT gate and a NAND gate which cooperate to form an overflow detection signal for the U/D counter 2 on the basis of the ignition signal IGt and the output signal of the NOR gate 9.

Reference numeral 15 designates a resistor for limiting a base current of a power transistor designated by 16 for driving the ignition coil 3.

Reference numerals 12 and 13 respectively designate flip-flops of the D type which are combined together to form a logical differentiating circuit. Further, a combination of two inverters 19 and 20, two resistors 21 and 22, and a capacitor 23 forms an oscillation circuit for producing a clock pulse to be supplied to the U/D counter 2. A frequency divider circuit 24 is provided to divide the oscillation frequency of an output signal of the oscillation circuit so as to produce a clock pulse having a frequency of 1/N of the oscillation frequency. These clock pulses are inputted to the AND-OR selector gate 3.

Next, referring to the waveform diagram of FIG. 2, the operation of the ignition system of the present invention will be described. The ignition signal IGt produced from the ECU 200 is shown in the diagram (1) of FIG. 2. The ignition signal IGt has a width corresponding to a predetermined crank angle and a falling edge representing an ignition timing St.

This ignition signal IGt is supplied to the Schmitt trigger circuit 1 in the ignitor 100 to be shaped there, and then the shaped ignition signal is supplied to the U/D input terminal of the U/D counter 2. In response to the ignition signal IGt, the U/D counter 2 counts up when the ignition signal IGt is at a high level (hereinafter simply referred to as "High"), while the U/D counter 2 counts down when the ignition signal IGt is at a low level (hereinafter simply referred to as "Low"), as shown in the diagram (2) of FIG. 2.

Figure 2:
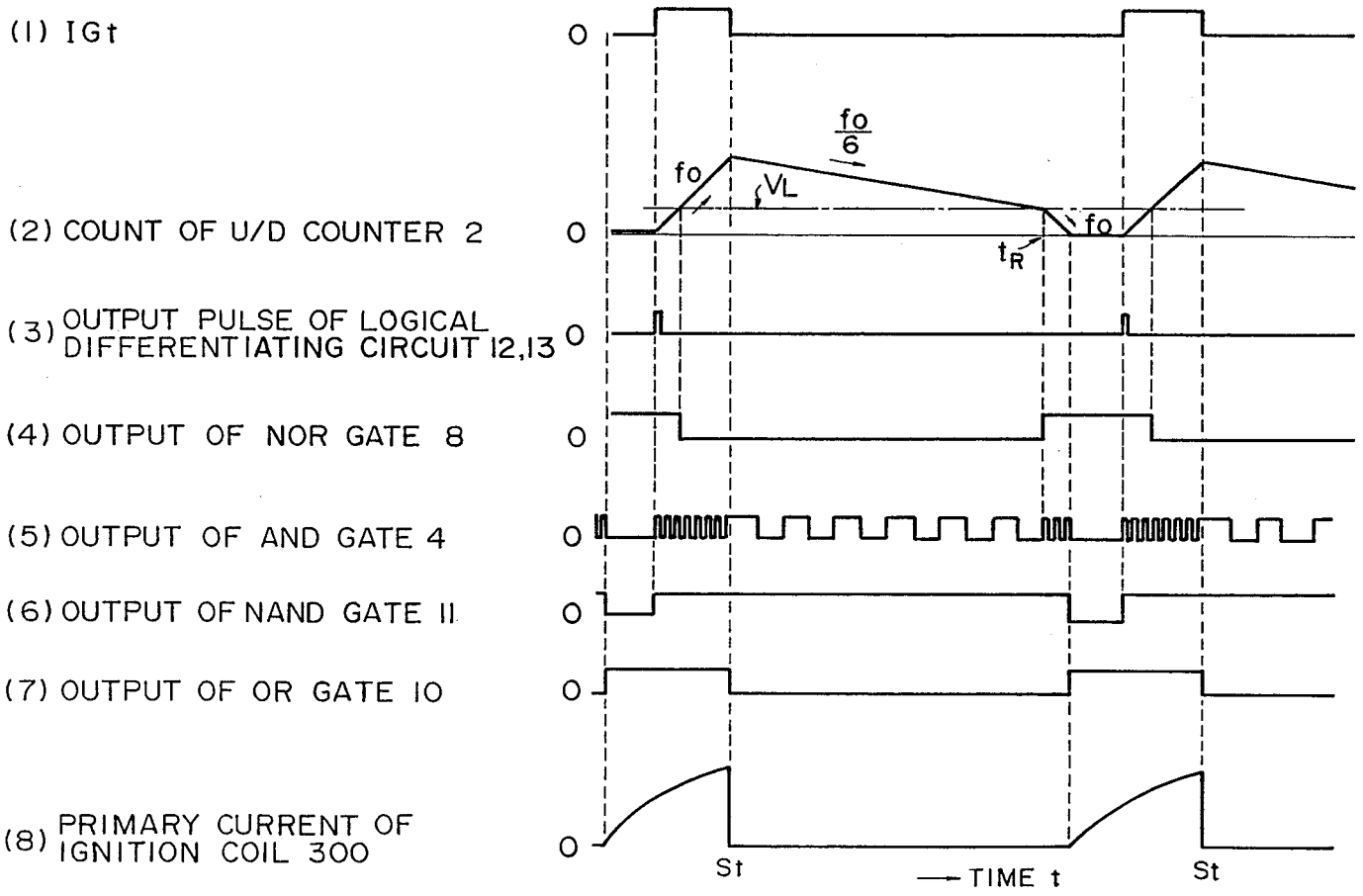
FIG. 2 is a waveform diagram showing waveforms at various portions of the ignition system shown in FIG. 1 which is useful for explaining the operation of the ignition system.

This U/D counter 2 is reset to an initial value "0" by the application thereto of a pulse shown in the diagram (3) of FIG. 2 which is produced from the logical differentiating circuit 12, 13 at the leading edge of the ignition signal IGt. Therefore, the operation of the U/D counter 2 is initiated always at the leading edge of the ignition signal IGt.

The U/D counter clock is produced by the oscillation circuit constituted by the two NOT gates 19 and 20, the two resistors 21 and 22, and the capacitor 23. Here, the frequency of this clock is represented by $f_0$. The output of the oscillation circuit is supplied to the frequency divider circuit 24 where the frequency $f_0$ is divided to produce a frequency of 1/N of the frequency $f_0$. As an example, the frequency of the output of the oscillation circuit is divided by this frequency divider circuit 24 into a frequency of 1/6 of the frequency $f_0$, that is, to obtain $f_0/6$. These two clocks having the respective frequencies $f_0$ and $f_0/6$ are applied to the AND-OR selector gate 3.

The opening and closing of the AND-OR selector gate 3 is controlled through the gates 5, 6, and 7 in response to the ignition signal IGt and the output of the NOR gate 8 shown in the diagram (4) of FIG. 2. As a result, as shown in the diagram (5) of FIG. 2, the U/D counter 2 counts up with the frequency $f_0$ when the ignition signal IGt is "High", while it counts down with the frequency of $f_0/6$ when the ignition signal IGt is "Low". When the count of the U/D counter 2 becomes not more than a value $V_L$ preset by the NOR gate 8 at a time point $t_R$ shown in FIG. 2, the clock frequency for its down-counting operation is switched from $f_0/6$ to $f_0$ again.

The NOR gate 9 detects the fact that the count of the U/D counter 2 has reached the initial value "0", and it operates to initiate the primary current flow through the ignition coil 300 from the time point when the count has become "0". On the other hand, in order to stop the counting operation of the U/D counter 2 when the count of the U/D counter 2 has become "0" detection output of the NOR gate 9 causes the NAND gate 11 to produce an output signal shown in the diagram (6) of FIG. 2. This output signal of the NAND gate 11 is applied to the AND gate 4 provided before the clock input of the U/D counter 2 to thereby perform inhibition and permission of the clock input to the U/D counter 2. Thus, the circuit arrangement for performing the switching of the clock frequency and the inhibition and permission of the clock input can be easily made by using logical circuits or logical gates.

The setting of the energization period of the ignition coil 300 is made at a time point when the count of the U/D counter 2 has become the initial value "0". That is, the primary current of the ignition coil 300 is caused to flow from a time point when the count of the U/D counter 2 has become "0" to a time point when the ignition signal IGt becomes "Low". To this end, the output of the NOR gate 9 and the ignition signal IGt from the Schmitt trigger circuit 1 is ORed by the OR gate 10, and the OR gate 10 produces a primary coil energization signal shown in the diagram (7) of FIG. 2 while it inputs the "High" ignition signal IGt and the "High" output of the NOR gate 9 generated when the NOR gate 9 receives "0" at all its inputs. The output signal of the OR gate 10 is applied to the base of the power transistor 16 through the resistor 15. The power transistor 16 causes the primary current of the ignition coil 300 to flow or to stop flowing, as shown in the diagram (8) of FIG. 2, in response to the signal applied to the base thereof.

Figure 3:
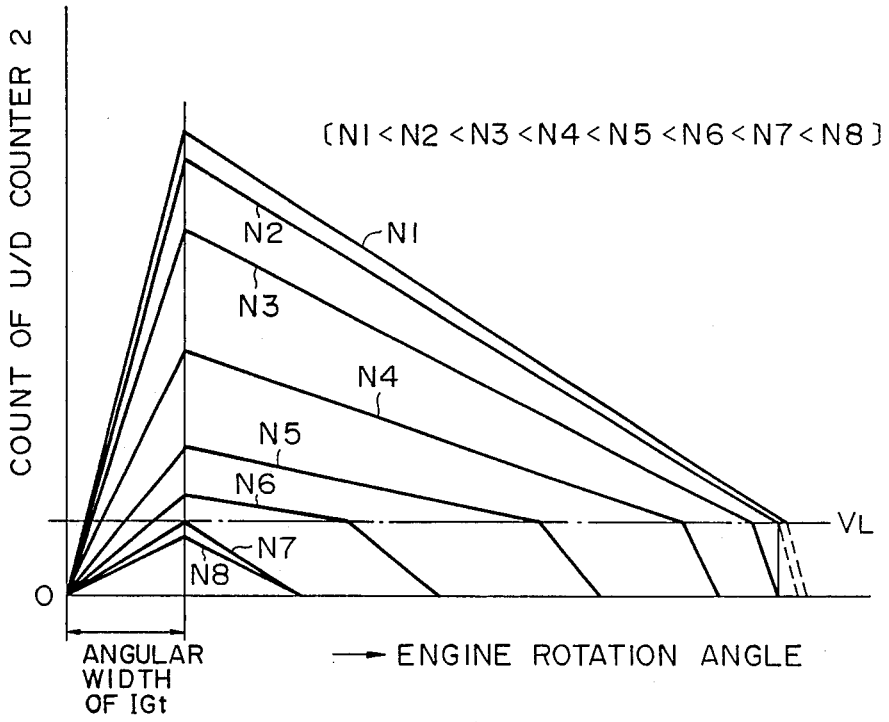
FIG. 3 is a characteristic diagram showing the count characteristics of the up-down counter in the ignition system shown in FIG. 1.

FIG. 3 shows the count characteristics of the U/D counter 2 in the above-described first embodiment. In the low engine speed region below a predetermined value (for example, at the speeds N1, N2, and N3), the ignition signal IGt becomes "High" before or at a time point when the count of the U/D counter 2 becomes "0". Thus, the energization of the primary coil of the ignition coil 300 is initiated at a position of a fixed rotational angle where the ignition signal IGt becomes "High". On the other hand, in the high engine speed region over a predetermined value (for example, at the speeds N7 and N8), the ignition signal IGt becomes "Low" before or at a time point when the count of the U/D counter 2 increases and reaches the value $V_L$ set by the NOR gate 8, so that the down-counting of the U/D counter 2 is started with the same frequency as that in the up-counting. Thus, the energization of the primary coil of the ignition coil 300 is initiated at a position of a certain substantially fixed rotational angle. In the intermediate engine speed region between the above-mentioned two regions (for example, at the speeds N4, N5, and N6), the angular position where the count of the U/D counter 2 becomes "0", namely, when the energization of the primary coil of the ignition coil 300 is initiated is advanced as the engine speed increases.

Figure 4:
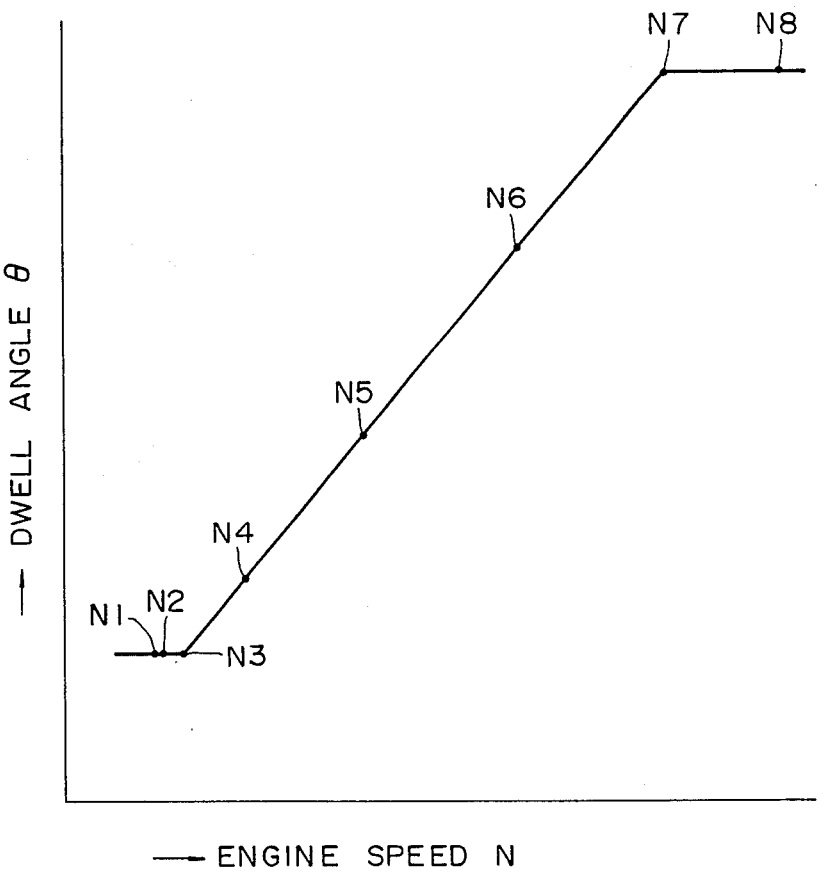
FIG. 4 is a characteristic diagram showing the engine speed versus the dwell angle characteristics of the ignition system of FIG. 1.

Therefore, as the characteristics of the dwell angle (the primary coil energization angle) $\theta$ of the ignition coil 300 versus the engine speed N, as shown in FIG. 4, the dwell angle $\theta$ is maintained at a fixed value determined by the angular width of the "High" pulse of the ignition signal IGt in the low engine speed region below the engine speed N3, it is increased in proportion to the engine speed N in the engine speed region from N3 to N7, and then it is maintained at a substantially fixed value in the high engine speed region over the engine speed N7.

Consequently, even by using a circuit having such a simple construction it is possible to perform energization time control to limit the energization time in the high engine speed region and to maintain the energization time substantially fixed in the middle engine speed rotation region.

Generally, in a circuit for forming such break point control as described above, since successive positions before reaching the break point are counted in terms of time, it is necessary to use a large-scale circuit such as a monostable multivibrator or a counter, as disclosed, for example, in Japanese Patent Unexamined Publication No. 23394/1980. In this embodiment of the present invention, however, the same control can be achieved by using only a simple logical gate 8, and therefore it is possible to use a small-scale circuit still having high precision.

Figure 5:
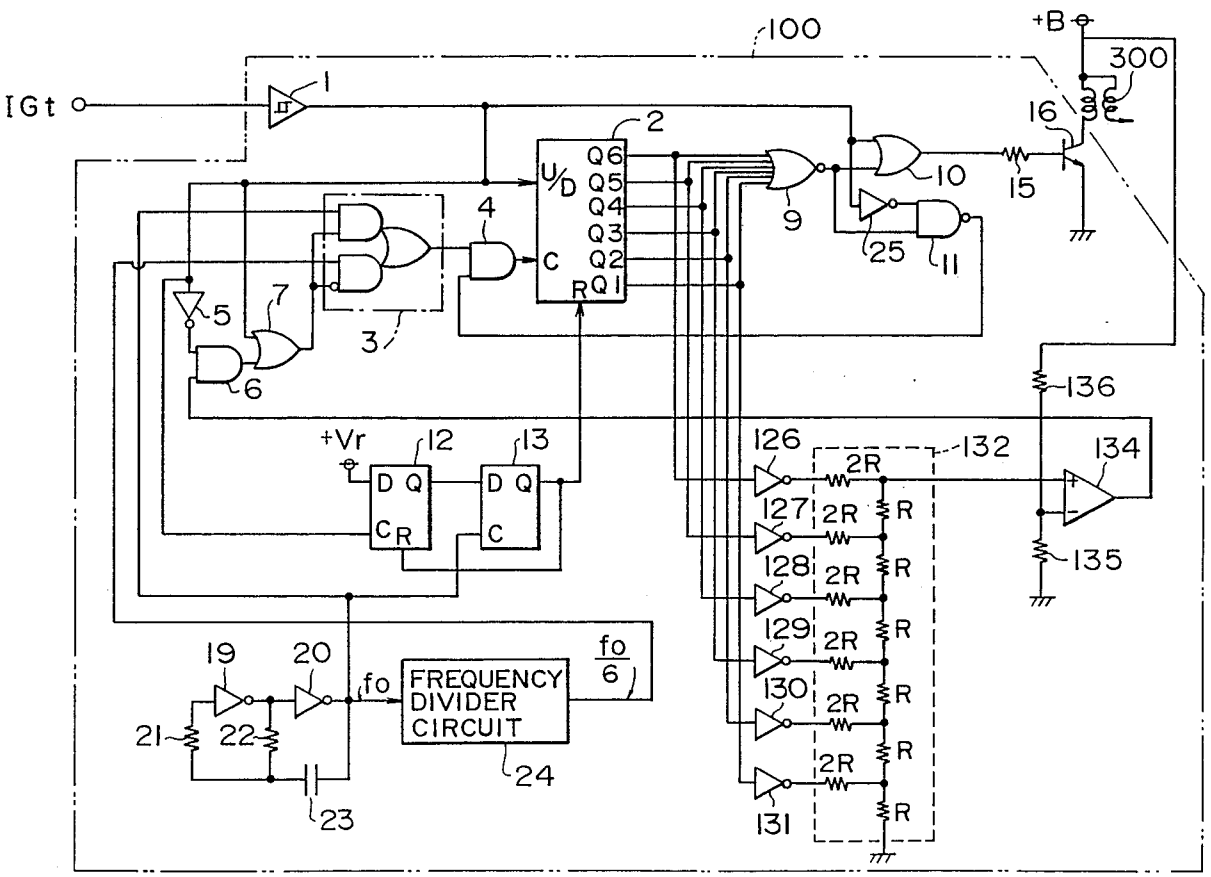
FIG. 5 is an electric circuit diagram showing an ignition system for internal combustion engines of a second embodiment of the present invention.
Figure 6:
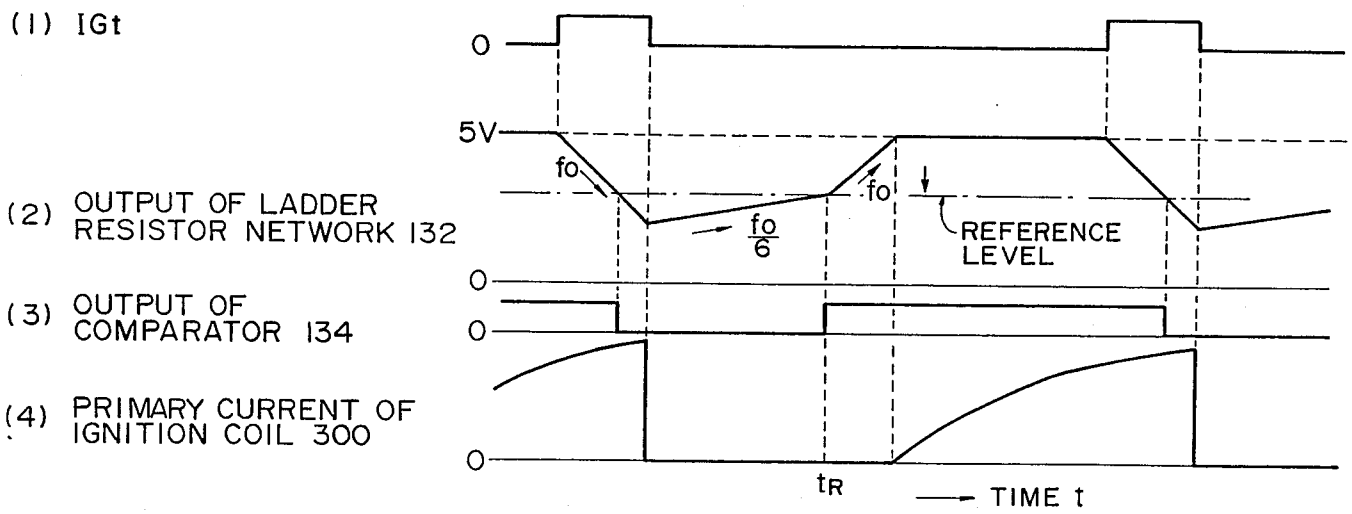
FIGS. 6 and 7 are waveform diagrams showing waveforms appearing at various portions of the ignition system shown in FIG. 5 which is useful for explaining the operation of the ignition system.
Figure 7:
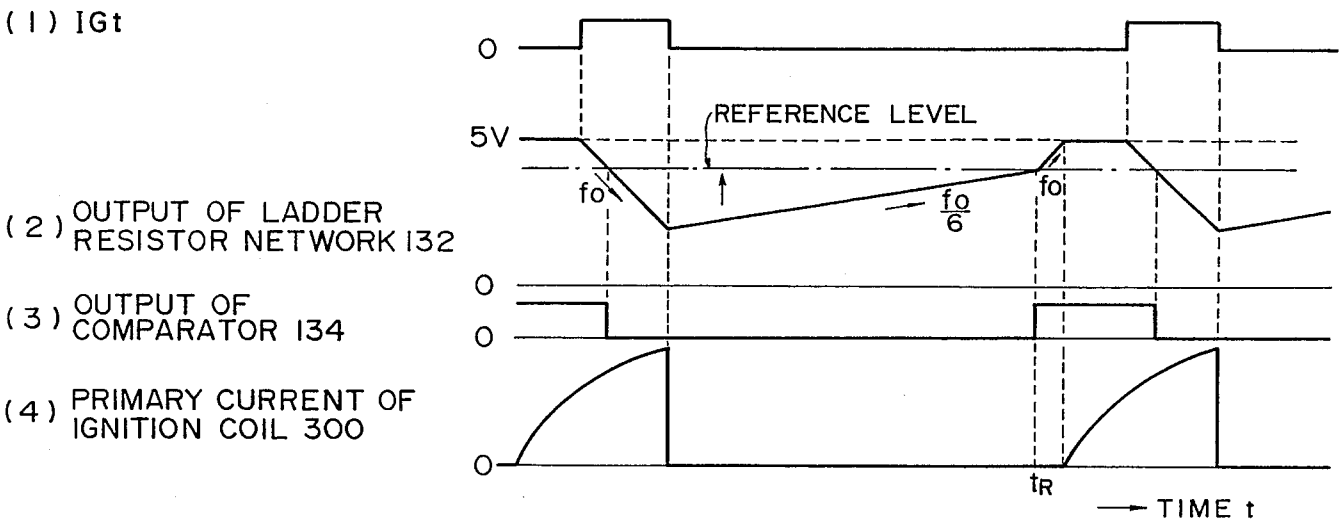

FIG. 5 is a circuit diagram showing a second embodiment of the present invention, and FIGS. 6 and 7 are waveform diagrams showing waveforms appearing at various portions of the ignition system of the second embodiment. The second embodiment is different from the first embodiment in that, in the operation of the U/D counter 2, the time point of the break point (the switching point of the clock frequency) in the down-counting operation can be varied in accordance with a power supply voltage. Generally, the lower the power supply voltage is, the longer the energization time of the primary coil of the ignition coil 300 should be, while, the higher the power supply voltage is, the shorter the energization time of the primary coil of the ignition coil 300 should be. Then, the power supply voltage depending characteristics may be established by lowering the break point level when the power supply voltage is high, while, by raising the break point level when the power supply voltage is low. The operation of the U/D counter 2 in the second embodiment will be described with respect to the cases where the power supply voltage is low and high, respectively, with reference to the waveform diagrams of FIGS. 6 and 7.

In the second embodiment, although the circuit arrangement thereof is basically the same as that of the first embodiment, output bits of the U/D counter 2 are inverted by respective corresponding NOT circuits 126 through 131 and then are applied to a ladder resistor network 132 constituted by a plurality of resistors R and 2R.

As a result, the output of the U/D counter 2 is inverted and then converted to an analog voltage shown in the diagram (2) of FIG. 6 and that of FIG. 7. This analog output is applied to the plus side input terminal of a comparator 134 which acts as second storage quantity detecting means. A reference level signal obtained by dividing a power supply voltage +B through a voltage divider constituted by resistors 136 and 135 is applied to the minus side input terminal of the comparator 134.

When the analog output of the ladder resistor network 132 becomes higher than the reference level at a time point $t_R$ shown in each of FIGS. 6 and 7, the output of the comparator 134 turns "High", and the clock frequency for the down-counting operation is changed from $f_0/6$ to $f_0$ again.

Therefore, when the power supply voltage falls, the reference level of the comparator 134 decreases as shown in the diagram (2) of FIG. 6, so that the time point of the break point is advanced, and, as a result, the duration of the primary current of the ignition coil 300 is extended as shown in the diagram (4) of FIG. 6.

On the other hand, when the power supply voltage rises, the reference level of the comparator 134 increases as shown in the diagram (2) of FIG. 7, so that the time point of the break point is retarded, and, as a result, the duration of the primary current of the ignition coil 300 is shortened as shown in the diagram (4) of FIG. 7. Further, the energization time of the primary coil of the ignition coil 300 may be easily set by adjusting a voltage dividing ratio determined by the resistance values of the resistors 135 and 136.

The diagram (1) in each of FIGS. 6 and 7 shows a signal waveform of the ignition signal IGt.

The waveform shown in the diagram (2) of each of FIGS. 6 and 7 is upside down as compared with the up/down count waveform of the U/D counter 2 in the first embodiment shown in the diagram (2) of FIG. 2. However, it is a matter of course that the same effects as those of the first embodiment can also be obtained by the second embodiment.

Further, although a digital type circuit construction has been embodiment in the above-described embodiments, the present invention is not necessarily limited to this construction but instead an analog type circuit may be employed by replacing the U/D counter 2 by a capacitor to be used as the storing means, replacing the oscillation circuit by a constant voltage circuit, and using a comparator as the first and second storage quantity detecting means.

As described above, the ignition system for an internal combustion engine according to the present invention is constructed so that, in response to each of the ignition signals from the ignition signal generating means through a predetermined angle before a succeeding ignition timing, the storage quantity of the storing means is gradually increased from the initial value and then gradually decreased, and a time point when the storage quantity has been decreased to reach the initial value is detected by the first storage quantity detecting means so that the power transistor is turned on at that time point, and further the fact that the storage quantity of the storing means has been decreased to reach a set value larger than the initial value is detected by the second storage quantity detecting means to thereby change the decrease rate of the storage quantity. Therefore, the present invention has excellent functional effects of performing a control operation to limit the primary coil energization time in the high engine speed region and to maintain a substantially constant primary coil energization time in the middle engine speed region still by using a simple circuit construction and besides obtaining sufficient ignition energy even during quick acceleration of the internal combustion engine.

What is claimed is:

1. An ignition system for an internal combustion engine comprising:

an ignition coil for generating a high voltage for ignition upon turning off of a primary current flowing therethrough;

a power transistor for turning on and off the primary current flowing through said ignition coil;

ignition signal generating means for producing an ignition signal having a predetermined angular width for turning off said power transistor at an ignition timing in synchronism with the rotation of said internal combustion engine;

storing means having a storage quantity increased gradually from an initial value in response to each said ignition signal through a predetermined angle before a succeeding ignition timing and then decreased gradually;

first storage quantity detecting means for detecting a first time point at which the storage quantity of said storing means has been decreased to reach the initial value and producing a first detection output signal for turning on said power transistor at the first time point; and second storage quantity detecting means for detecting a second time point at which the storage quantity of said storing means has been decreased to reach a set value larger than the initial value and producing a second detection output signal for changing a decrease rate of the storage quantity of said storing means at the second time point.

2. An ignition system for an internal combustion engine comprising:

an ignition coil for generating a high voltage for ignition upon turning off of a primary current flowing a therethrough;

a power transistor for turning on and off the primary current flowing through said ignition coil;

ignition signal generating means for producing an ignition signal having a predetermined angular width for turning off said power transistor at an ignition timing in synchronism with the rotation of said internal combustion engine;

count storing means counting a clock signal supplied thereto from a clock signal generator and having a count storage quantity increased gradually from an initial value in response to each said ignition signal through a predetermined angle before a succeeding ignition timing and then decreased gradually;

first count storage quantity detecting means for detecting a first time point at which the count storage quantity of said count storing means has been decreased to reach the initial value and producing a first detection output signal for turning on said power transistor at the first time point; and second count storage quantity detecting means for detecting a second time point at which the count storage quantity of said count storing means has been decreased to reach a set value larger than the initial value and producing a second detection output signal for changing a decrease rate of the count storage quantity of said count storing means at the second time point.

3. An ignition system for an internal combustion engine comprising:

an ignition coil for generating a high voltage for ignition upon turning off of a primary current flowing therethrough;

a power transistor for turning on and off the primary current flowing through said ignition coil;

ignition signal generating means for producing an ignition signal having a predetermined angular width for turning off said power transistor at an ignition timing in synchronism with the rotation of said internal combustion engine;

count storing means counting a clock signal supplied thereto from a clock signal generator and having a count storage quantity increased gradually from an initial value in response to each said ignition signal through a predetermined angle before a succeeding ignition timing and then decreased gradually;

count storage quantity detecting means for detecting a time point at which the count storage quantity of said count storing mean has been decreased to reach the initial value and producing a detection output signal for turning on said power transistor at the detected time point;

a D-A converter for converting a logical output of said count storing means which represents the count storage quantity thereof, to a corresponding analog output voltage; and a comparator for comparing the analog output voltage from said D-A converter with a reference dc voltage proportional to a power supply voltage and producing a comparison output signal on the basis of a result of the comparison for changing a decrease rate of the count storage quantity of said count storing means.

4. An ignition system for an internal combustion engine according to claim 2, wherein said count storing means is constituted by an up/down counter.

5. An ignition system for an internal combustion engine according to claim 3, wherein said count storing means is constituted by an up/down counter.

6. An ignition system for an internal combustion engine according to claim 2, wherein said first count storage quantity detecting means is constituted by an NOR gate.

7. An ignition system for an internal combustion engine according to claim 3, wherein said count storage quantity detecting means is constituted by an NOR gate.

8. An ignition system for an internal combustion engine according to claim 2, wherein said second count storage quantity detecting means is constituted by an NOR gate, and said ignition system further comprises, as means for changing the decrease rate of the count storage quantity of said count storing means, a logical circuit responsive to a detection output signal from said NOR gate of said second count storage quantity detecting means for switching a clock frequency of the clock signal supplied to said count storing means.

9. An ignition system for an internal combustion engine according to claim 3 further comprising, as means for changing the decrease rate of the count storage quantity of said count storing means, a logical circuit responsive to the comparison output signal from said comparator for switching a clock frequency of the clock signal supplied to said count storing means.

10. An ignition system for an internal combustion engine according to claim 2 further comprising a logical circuit driven by the ignition signal and the first detection output signal of said first count storage quantity detecting means for performing inhibition and permission of supplying the clock signal to said count storing means.

11. An ignition system for an internal combustion engine according to claim 3 further comprising a logical circuit driven by the ignition signal and the detection output signal of said count storage quantity detecting means for performing inhibition and permission of supplying the clock signal to said count storing means.

* * * * *